US006676775B2

(12) United States Patent
Barth et al.

(10) Patent No.: US 6,676,775 B2
(45) Date of Patent: Jan. 13, 2004

(54) RECRYSTALLIZATION-HARDENABLE ALUMINUM CAST ALLOY AND COMPONENT

(75) Inventors: Andreas Barth, Leinfelden (DE); Mohamed Douaoui, Kernen i.R. (DE)

(73) Assignee: DaimlerChrysler AG, Stuttgart (DE)

( * ) Notice: Subject to any disclaimer, the term of this patent is extended or adjusted under 35 U.S.C. 154(b) by 65 days.

(21) Appl. No.: 10/016,138

(22) Filed: Dec. 17, 2001

(65) Prior Publication Data

US 2002/0088509 A1 Jul. 11, 2002

(30) Foreign Application Priority Data

Dec. 15, 2000 (DE) ..... 100 62 547

(51) Int. Cl.[7] ..... C22C 21/02
(52) U.S. Cl. ..... 148/415; 420/546; 420/547
(58) Field of Search ..... 420/534, 546, 420/547; 148/415, 417

(56) References Cited

U.S. PATENT DOCUMENTS

| | | |
|---|---|---|
| 4,099,314 A | 7/1978 | Perrot et al. |
| 4,243,438 A | 1/1981 | Yanagida et al. |
| 5,240,521 A | 8/1993 | Crum et al. |

FOREIGN PATENT DOCUMENTS

| | | |
|---|---|---|
| CH | 168202 | 3/1934 |
| DE | 42 15 160 | 5/1992 |
| DE | 4215160 | 11/1993 |
| DE | 44 04 420 | 2/1994 |
| DE | 69322460 | 6/1999 |
| EP | 0861911 | 9/1998 |
| EP | 0587186 | 12/1998 |
| GB | 394746 | 7/1933 |
| JP | 03120334 | 5/1991 |
| JP | 11082151 | 3/1999 |

OTHER PUBLICATIONS

European Search Report and Translation thereof.
Zschech, E.: Metallkunkliche Prozesse bei der Wärmebehandlung aushärtbarer Aluminiumlegierungen. In : HTM 51, 1996, 3, S. 137–144.
German Search report dated Feb. 13, 2002 and English blank.
German Office Action 10062547.9.

*Primary Examiner*—George Wyszomierski
*Assistant Examiner*—Janelle Combs Morillo
(74) *Attorney, Agent, or Firm*—Crowell & Moring LLP

(57) ABSTRACT

A recrystallization-hardenable aluminum cast alloy includes in addition to aluminum the following elements as functional elements: (1) 5 to 10 weight % silicon, (2) 0.2 to 0.35 weight % magnesium, (3) 0.3 to 3 weight % nickel and/or 0.6 to 3 weight % cobalt, and impurities due to manufacturing.

10 Claims, 2 Drawing Sheets

RECRYSTALLIZATION-HARDENABLE ALUMINUM CAST ALLOY AND COMPONENT

This application claims the priority of German patent document 100 62 547.9, filed Dec. 15, 2000, the disclosure of which is expressly incorporated by reference herein.

BACKGROUND AND SUMMARY OF INVENTION

The present invention relates to an aluminum cast alloy and to a component.

A recrystallization-hardenable aluminum alloy is known in the art from DE 44 04 420 A1 which has the following composition:

8.0 to 10.9 weight % silicon, 0.8 to 2.0 weight % magnesium, 4.0 to 5.9 weight % copper, 1.0 to 3.0 weight % nickel, 0.2 to 0.4 weight % manganese, and less than 0.5 weight % iron.

(weight %=per cent by weight, proportion of the individual elements in the total material mass of alloy.)

This alloy is especially designed for pistons in internal combustion engines. The relatively high silicon share produces good resistance to wear and tear and high solidity even at high temperatures. The remaining alloy elements prevent sharp primary silicon crystals from forming that constitute, at alternating loads, the starting points for repeated stress failures. However, components of this type only have limited breaking elongations.

DE 42 15 160 C2 describes an aluminum alloy for pressure die casting applications that ensures ease in removing the mold of a component from the pressure die casting mold. Aside from 99.7% pure primary aluminum pig, it has the following composition:

5.0 to 12.0 weight % silicon, 0 to 0.8 weight % magnesium, less than 0.01 weight % copper, less than 0.2 weight % iron, 0.1 to 0.5 weight % cobalt.

In general, iron is added to the alloy to reduce the adhesion between the component and the die casting mold of the alloy; however, at higher concentrations, this increases the brittleness of the component. In this context, it is cobalt in particular that manifests the functional property of reducing the adhesion properties of the component to the die casting mold without leading to an increase in brittleness. Consequently, the iron portion can be greatly reduced.

The brittleness of the alloy, addressed previously, which is attributable to the different elements of the alloy and is acceptable for use as a compromise in various applications, will lead to failures for certain highly stressed components. This is true, in particular, with regard to engine components such as cylinder heads or cylinder crank cases. These components operate under particularly high temperatures, pressures and alternating loads. Moreover, complex geometry-specific reasons are responsible for extensive notch effects. If component failures are to be avoided, extraordinarily high ductility of the material is required in these cases. In particular, this applies with respect to modern high performance engines in which the loads on the cylinder heads are steadily increasing.

Therefore, it is an object of the present invention to provide an alloy that is suitable for producing components with thermal stability, high breaking elongation and high ductility while, simultaneously, the susceptibility to corrosion is minimal.

The alloy according to the present invention contains a silicon part of between 5% and 10%. If the silicon part were lower, it would impair the castability of the alloy. If the silicon part were higher, it would result in the embrittlement of the material. Preferably, the silicon part is between 6.5% and 7.5%.

Together with the silicon, the alloy element magnesium forms $Mg_2Si$ (magnesium silicide) crystals, thereby increasing the stability. If the magnesium part is below the lower limit according to the invention, the stability of the resulting component is too low; if the magnesium part is above 0.35%, the $Mg_2Si$ crystals cause excessive brittleness.

The alloy element nickel forms, in conjunction with aluminum, intermetallic phases, such as e.g. $Al_3Ni$ (nickel aluminide), that improve the thermal stability and do not congruently melt until temperatures of over 800° C. are reached (in contrast to $Al_2Cu$ (copper aluminide) that forms in alloys containing copper and melts at temperature below 600° C.). Moreover, the phases containing aluminum and nickel do not have any negative effect on the ductility of the material. The nickel part of the alloy according to the present invention is between 0.3% and 3%, preferably between 0.5% and 2.5%.

It is possible to add cobalt as an alloy element to the alloy according to the invention. Cobalt also forms intermetallic compounds on the basis of aluminum and cobalt, similar to the compounds on the basis of aluminum and nickel, thereby increasing the thermal stability. The alloy according to the invention can contain between 0.6 weight % and 3 weight % of cobalt.

Iron, which is used to reduce the breaking elongation, is not necessary for the alloy according to the invention. The same applies with regard to copper as an alloy element, which reduces the corrosion resistance.

Another objective according to the invention is a component. The component is cast from an alloy according to the present invention and has the advantages resulting from this alloy.

A thermal treatment of the component, preferably following a solution heat treatment, leads to precipitation hardening (heat treatment) of an Al-matrix (which constitutes the component) by way of calculated precipitating of intermetallic phases, such as e.g. the $Mg_2Si$ or $Al_3Ni$. The precipitation hardening occurs within a temperature range of between 160° C. and 240° C. for a duration of between 0.2 hours to 10 hours. Particularly preferred is the precipitation hardening at temperatures of between 180° C. and 220° C. and for a duration of 0.5 hours to 8 hours. The length of the temperature treatment is dependent on the temperature. At higher temperatures, the heat treatment is considerably shorter.

The component, represented by way of the alloy according to the present invention, is preferably realized as a sand casting or permanent mold casting component since this facilitates the heat treatment referred to previously. For a component that is manufactured by way of the pressure die casting process, thermal treatment is not easily possible due to trapped air. In such cases, it would be necessary to use a vacuum pressure die casting process, which is more complex in terms of materials processing.

It is particularly useful if the component according to the present invention is realized as a cylinder head or as a cylinder crank case in an internal combustion engine. These components, especially cylinder heads, are exposed to very high pressures at high temperatures. Furthermore, the geometry of these components is highly complex, such as, for example, on the valve bars inside the cylinder head or on the cooling ducts inside the cylinder crank case. In particular at high temperatures, pressures, and alternating loads, these constructions act as notches and starting points for material failures. An especially high breaking elongation in combination with increased thermal stability offers considerable advantages.

Other objects, advantages and novel features of the present invention will become apparent from the following detailed description of the present invention when considered in conjunction with the accompanying drawings.

DETAILED DESCRIPTION OF THE DRAWINGS

A cylinder head of an internal combustion engine is cast with the permanent mold casting process using the alloy according to the present invention. The die casting parameters correspond to the customary process-specific procedural handling.

After casting and cooling, the component has a coarse grainy structure consisting of mixed crystals, because, in contrast to the majority of alloy elements, aluminum has a very low solubility at room temperature. Therefore, a solution heat treatment of the component follows, lasting for approximately 4 to 5 hours at a temperature of approximately 540° C. The alloy elements in the aluminum matrix become dissolved during this step. Subsequently, the component is quenched in water, and the alloy elements in the aluminum matrix stay dissolved.

Moreover, a recrystallization-hardening process is implemented during which the elements that are dissolved in the aluminum matrix are precipitated out of the matrix in a controlled fashion, forming mixed crystals. This process takes place over a period of 0.5 hours and at a temperature of 220° C. As an alternative, it is possible for the precipitation hardening to take place over a period of 8 hours and at a temperature of 180° C. The phases, forming during the recrystallization-hardening (precipitates), are intermetallic compounds, containing among other things $Mg_2Si$, which improves the solidity of the component, and $Al_3Ni$ (or other ternary and/or quaternary intermetallic compounds on aluminum and nickel basis), which improves the thermal stability of the component due to its high melting temperature.

The solidity and ductility of the component is adjustable through temperature control and the length of the temperature treatment, as referred to above and attributable to the precipitated crystals (for example, the intermetallic compounds $Mg_2Si$ and $Al_3Ni$).

In addition, the size of the $Mg_2Si$ and $Al_3Ni$ precipitates, which are also influenced by the heat treatment, has an effect on the properties of the component, which will be explained below.

Figure 1:
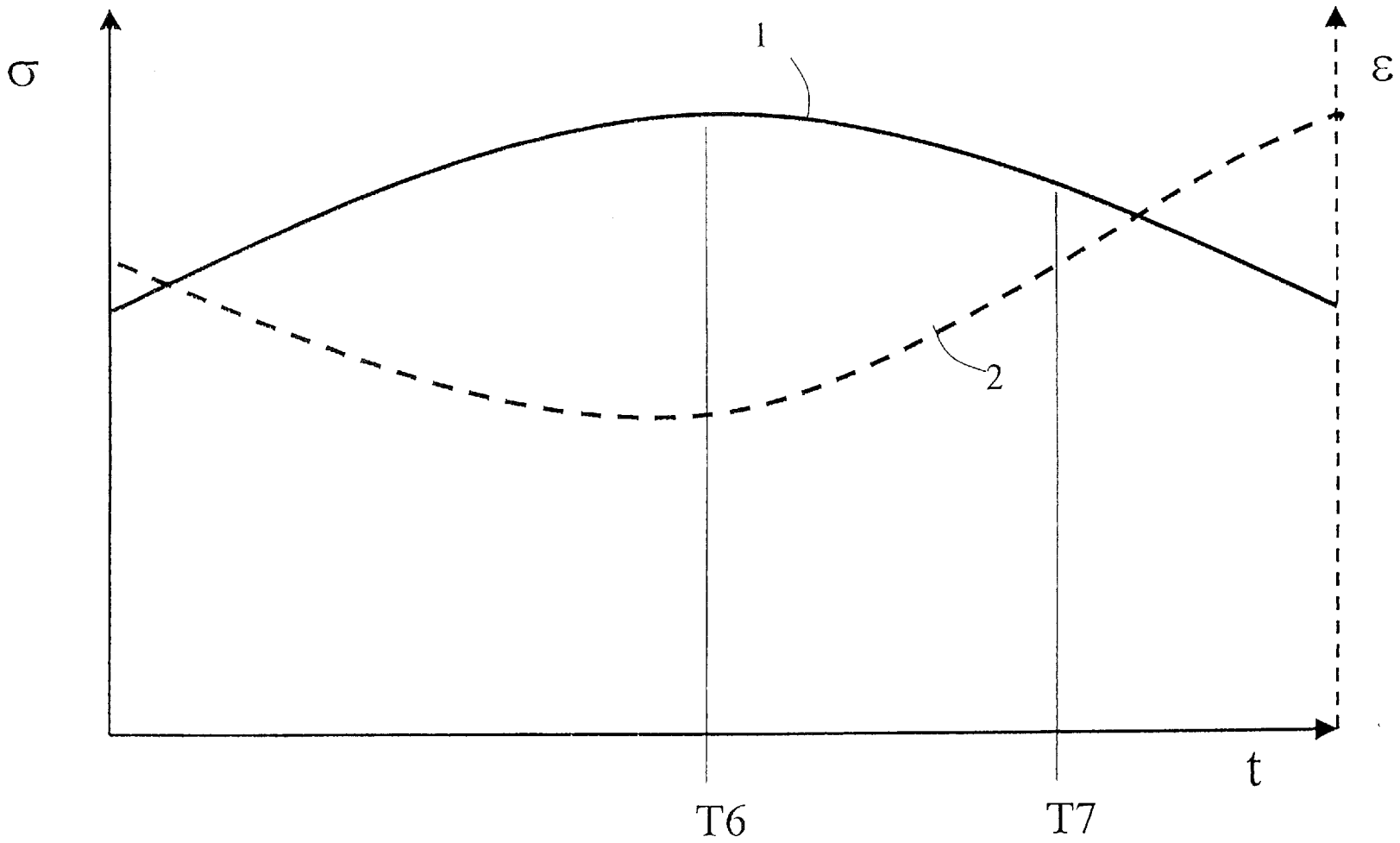
FIG. 1 shows the schematic recrystallization-hardening behavior of a component as a function of time and at a temperature T1.
Figure 2:
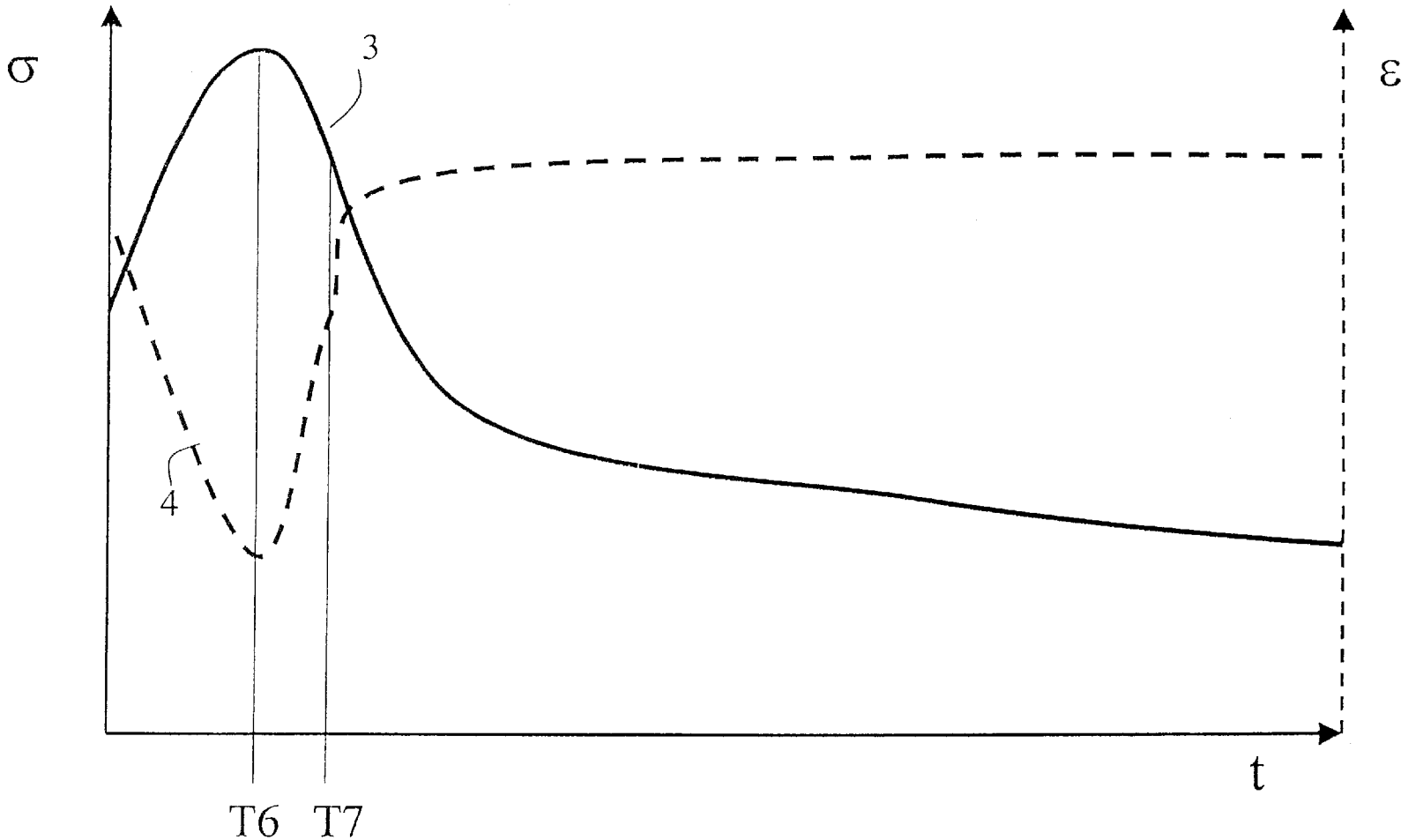
FIG. 2 shows the schematic recrystallization-hardening behavior of a component as a function of time and at a temperature T2, with T2 being greater than T1.

FIG. 1 and FIG. 2 are schematic representations of the solidity $\sigma$ of the component (left y-axis) and the breaking elongation $\epsilon$ (right y-axis) as a function of the duration of the heat treatment t. FIGS. 1 and 2 differ in terms of the temperature T of the heat treatments, with T in FIG. 1 being lower than T in FIG. 2. The traced curves 1 and 3 schematically show the course of solidity $\sigma$, the dotted lines 2 and 4 the course of the breaking elongation $\epsilon$.

Depending on the temperature, the component solidity reaches a maximum after a certain length of the heat treatment. This state is generally called T6. At this point, the structure of the component precipitates is very fine. Simultaneously, the breaking elongation reaches a minimum in state T6. If the thermal treatment is continued after the state T6 has been reached, so-called over-hardening occurs, which is designated as state T7. The advantage of state T7 consists in the fact that, owing to the coarser structure of the precipitates occurring in this state, the breaking elongation increases again.

The designations T6 and T7 are established industry terms. In the context of these terms, T does not stand for temperature.

During the thermal treating of the component according to the present invention, care needs to be taken that the solidity as well as the breaking elongation meet the requirements that apply with respect to the component. In general, depending on the task, a state T7 with breaking elongation that is as high as possible should be sought.

A comparison between FIG. 1 and FIG. 2 shows that the maximum and minimum of state T6 are clearly more strongly marked at a higher temperature (FIG. 2) and reached earlier than at lower temperatures (FIG. 1). However, at higher temperatures, it is more difficult to control the phase formation. The described thermal treatment at 220° C. for 1.2 hours represents a compromise of these aspects.

The alloy elements silicon and magnesium cause an increase in solidity and an upward shift of the curves 1 and 3. On the other hand, these elements cause the curves 2 and 4 to shift downward, which has a negative effect with regard to the breaking elongation. Surprisingly, it was found that nickel and cobalt, when used as alloy elements, cause the curves 1 and 3 to shift upward without exhibiting any negative effect with respect to the breaking elongation.

Consequently, adding nickel and/or cobalt by themselves, but especially in combination with a controlled thermal treatment that causes the formation of the desired precipitates of compounds on the basis of aluminum and nickel or aluminum and cobalt allowing for the advantageous adjustment of the grain structure, leads to the solution of the objective according to the present invention.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within the scope of the present invention.

What is claimed is:

1. A recrystallization-hardenable aluminum cast alloy, consisting of:

Aluminum, 5 to 7.5 weight % silicon, 0.2 to 0.35 weight % magnesium, at least one of 0.3 to 3 weight % nickel and 0.6 to 3 weight % cobalt, and impurities.

2. A recrystallization-hardenable aluminum cast alloy as claimed in claim 1, consisting of:

6.5 to 7.5 weight % silicon, 0.2 to 0.35 weight % magnesium, 0.5 of 2.5 weight % nickel and impurities due to manufacturing.

3. A component manufactured from an aluminum alloy, comprising at least locally as alloy elements consisting of:

5 to 7.5 weight % silicon, 0.2 to 0.35 weight % magnesium, at least one of 0.3 to 3 weight % nickel and 0.6 to 3 weight % cobalt, wherein the component contains phases comprising at least one of (1) aluminum and nickel and (2) aluminum and cobalt and that are present in the form of at least one of binary, ternary and quaternary intermetallic compounds.

4. A component manufactured from an aluminum alloy as claimed in claim 3, wherein the component contains at least locally as alloy elements consisting of:

6.5 to 7.5 weight % silicon, 0.2 to 0.35 weight % magnesium, 0.5 to 2.5 weight % nickel, and wherein the component contains phases comprising aluminum and nickel and are present in the form of at least one of binary, ternary, and quaternary intermetallic compounds.

5. A component as claimed in claim 3, wherein the component is heat treated for 0.2 hours to 10 hours at a temperature of between 160° C. and 240° C.

6. A component as claimed in claim 3, wherein the component is heat treated for 0.5 hours to 8 hours at a temperature of between 180° C. and 220° C.

7. A component as claimed in claim 3, wherein the component can be manufactured in a sand casting or permanent mold casting or vacuum pressure die casting process.

8. A component as claimed in claim 3, wherein the component is a cylinder head or a cylinder crank case of an internal combustion engine.

9. An internal combustion engine comprising a part comprising a cast alloy according to claim 1.

10. An internal combustion engine according to claim 9, wherein the part is a cylinder head or a cylinder crank case.

* * * * *